US006832502B1

(12) United States Patent
Whyte et al.

(10) Patent No.: US 6,832,502 B1
(45) Date of Patent: Dec. 21, 2004

(54) APPARATUS FOR SWAGING AN OBJECT

(75) Inventors: Ronald Whyte, Aberdeen (GB); Joseph K. Mudge, Aberdeen (GB); Thomas K. McLaughlin, Balmedic Aberdeenshire (GB)

(73) Assignees: Schoolhill Hydraulic Engineering Co. Ltd., Aberdeen (GB); Maxtube Limited, Aberdeen (GB)

( * ) Notice: Subject to any disclaimer, the term of this patent is extended or adjusted under 35 U.S.C. 154(b) by 0 days.

(21) Appl. No.: 09/913,370

(22) PCT Filed: Feb. 11, 2000

(86) PCT No.: PCT/GB00/00430

§ 371 (c)(1),
(2), (4) Date: Mar. 19, 2002

(87) PCT Pub. No.: WO00/47927

PCT Pub. Date: Aug. 17, 2000

(30) Foreign Application Priority Data

Feb. 12, 1999 (GB) ..... 9903150

(51) Int. Cl.[7] ..... B21D 41/04

(52) U.S. Cl. ..... 72/318; 72/467; 72/477; 72/370.06; 72/370.13

(58) Field of Search ..... 72/318, 467, 370.1, 72/370.11, 370.13, 476, 477, 370.03, 370.06, 370.01, 359, 358

(56) References Cited

U.S. PATENT DOCUMENTS 450,910 A * 4/1891 Fisher ..... 72/477
672,884 A * 4/1901 Bernnett ..... 72/477
1,059,354 A * 4/1913 Ehrhardt ..... 72/370.06
1,264,519 A * 4/1918 Hinson ..... 72/477
1,898,586 A 2/1933 Mazer
1,931,352 A * 10/1933 Kemp ..... 72/467
2,285,025 A * 6/1942 French ..... 72/477
2,767,605 A * 10/1956 Schmid ..... 72/477
3,164,045 A * 1/1965 Kennedy ..... 72/477
3,380,285 A * 4/1968 Wilson ..... 72/477
3,668,918 A * 6/1972 Benteler et al. ..... 72/370.13
4,211,103 A * 7/1980 Grimaldo ..... 72/316
4,383,429 A * 5/1983 Ceccacci ..... 72/318
4,805,495 A * 2/1989 Tauber ..... 72/476
4,827,754 A * 5/1989 Tanaka ..... 72/316
6,230,540 B1 * 5/2001 Wilch et al. ..... 72/370.1

* cited by examiner

*Primary Examiner*—Daniel C. Crane
(74) *Attorney, Agent, or Firm*—Wolf, Greenfield & Sacks, P.C.

(57) ABSTRACT

An apparatus for swaging an end of a tubular (22) is described as comprising a swaging head (17) for providing the swage to the end of the tubular (22). The swaging head (17) has two or more formations (22A, 22B) provided thereon to permit swaging of differing diameters of tubular ends. The apparatus may comprise a stop plate (5, 9) for abutment against the other end of a tubular (22) where the swaging head (17) and the stop plate (5, 9) are movably coupled to one another. The apparatus may have a clamping device (4) for clamping the tubular (22), where the clamping device is split into at least three part-circular clamping segments (30) which clamp around the outer circumference of the tubular to permit it to be swaged. The clamping device (4) may have a plurality of teeth (35) for gripping the outer surface of the tubular (22), and a plurality of grooves 36 formed between the teeth (35). The gripping surface of each tooth (35) is substantially parallel to the longitudinal axis of the tubular (2) to be gripped.

16 Claims, 15 Drawing Sheets

APPARATUS FOR SWAGING AN OBJECT

RELATED APPLICATIONS

This application claims the benefit under 35 U.S.C. §120 or 35 U.S.C. §365(c) of PCT International application PCT/GB00/00430 designating the United States of America, and filed Feb. 11, 2000.

Foreign priority benefits are claimed under 35 U.S.C. §119(a)–(d) or 35 U.S.C. §365(b) of Great Britain patent application number 9903150.2 filed Feb. 12, 1999, which designated at least one country other than the United States.

FIELD OF THE INVENTION

The present invention relates to an apparatus for swaging an object, and particularly relates to an apparatus for swaging an end of a tubular member, such as a length of casing or drillpipe used in the oil and gas industry.

Conventionally, casing tubulars have a standard pin type connector at each end, and one end of a casing tubular is connected to an end of another casing tubular by means of a casing joint, commonly known as a coupler, and which comprises a short length of tube having a standard box type connector at each end. Alternatively, tubulars, such as drill pipe in particular, have a standard pin type connection at one end and a standard box type connection at the other end.

It is important that a made up tubular string, such as a casing, lining or drill string has a substantially linear throughbore at the joints between the respective tubulars, and couplers if present.

The pin and/or box connections are conventionally made up on a tubular by first swaging respectively inwardly or outwardly the outer diameter of the ends of the pipe by a suitable amount so that pins can be formed. This swaging of the outer diameter of the pipe necessarily respectively reduces or increases the internal diameter of the pipe end.

After the end of the pipe has been swaged, the internal or external diameter of the end of the pipe is then machined. The swaging process ensures that there is material around the entire circumference of the internal or external diameter of the pipe that can be machined away, thereby achieving concentricity of the internal or external diameter of the pipe end. Additionally, this ensures that there are no thick or thin sections of wall thickness on the pipe end, thereby ensuring a constant wall thickness to the pipe end.

Thereafter, the screw thread of the pipe end can be formed on its outer or inner circumference.

A conventional machine for swaging an end of a pipe comprises a swaging head having a single swaging formation thereon for swaging a particular diameter of pipe. The pipe to be swaged is held between a semi-circular lower clamp and two upper quarter circular segments, where the two upper segments are hinged to the lower semi-circular clamp to permit the pipe to be inserted into the clamp. The clamp is provided with plurality of teeth, in a saw tooth arrangement, to grip the pipe. However, with the saw tooth arrangement, the teeth tend to bite into and damage the outer wall of the pipe. Furthermore, where the pipe has slight variations in the outer circumference of its wall, the teeth will tend to grip certain parts of the outer diameter more forcefully than other parts, since the clamping device is substantially immoveable once it has been closed.

According to a first aspect of the present invention, there is provided an apparatus for swaging an end of a tubular, the apparatus comprising a swaging head for providing the swage to the end of the tubular, wherein the swaging head has two or more swaging formations provided thereon to permit swaging of differing diameters of tubular ends.

The swaging formation may be provided on an internal bore of the swaging head, such that the internal bore of the swaging head engages the outer diameter of the tubular end to provide the swage thereto.

Each swaging formation may comprise a first diameter of the swaging head, a second diameter being smaller than the first diameter, a third diameter being smaller than the second diameter, and a fourth diameter being smaller than the third diameter. Preferably, the internal bore of the swaging head tapers substantially linearly inwardly, with respect to the longitudinal axis of the swaging head, from the first diameter to the second diameter, and from the second diameter to the third diameter. Typically, the angle of the taper from the first to the second diameter is greater than the angle of the taper from the second to third diameter. Typically, the surface of the internal bore of the swaging head provided by the taper from the first to the second diameter is a guiding surface, and the surface provided by the taper from the second to third diameter is a swaging surface.

The surface of the internal bore of the swaging head from the second/third diameter co the third/fourth diameter may be arranged to be substantially perpendicular to the longitudinal axis of the swaging head, and is preferably arranged to provide a shoulder or a stop surface against which the tubular end arrests.

Preferably, the swaging head is arranged with at least first and second swaging formations, whereby the fourth diameter of the first swaging formation is greater than the first diameter of the second swaging formation. Typically, the first diameter of the first swaging formation is the closest diameter of all of the diameters of all of the swaging formations to the tubular end, in use.

Alternatively, the swaging, formation may be provided on an external diameter of the swaging head, such that the external diameter of the swaging head engages the inner diameter of the tubular end to provide the swage thereto.

Each swaging formation may comprise a first diameter of the swaging head, a second diameter being greater than the first diameter, a third diameter being greater than the second diameter, and a fourth diameter being greater than the third diameter. Preferably, the external diameter of the swaging head tapers substantially linearly outwardly, with respect to the longitudinal axis of the swaging head, from the first diameter to the second diameter, and from the second diameter to the third diameter. Typically, the angle of the taper from the first to the second diameter is greater than the angle of the taper from the second to third diameter. Typically, the surface of the external diameter of the swaging head provided by the taper from the first to the second diameter is a guiding surface, and the surface provided by the taper from the second to third diameter is a swaging surface.

The surface of the external diameter of the swaging head from the second/third diameter to the third/fourth diameter may be arranged to be substantially a perpendicular to the longitudinal axis of the swaging head, and is preferably arranged to provide a shoulder or a stop surface against which the tubular end arrests.

Preferably, the swaging head is arranged with at least first and second swaging formations, whereby the fourth diameter of the first swaging formation is smaller than the first diameter of the second swaging formation. Typically, the first diameter of the first swaging formation is the closest diameter of all of the diameters of all of the swaging formations to the tubular end, in use.

Two or more swaging formations may be provided.

According to a second aspect of the present invention, there is provided an apparatus for swaging an end of a tubular, the apparatus comprising a swaging head for swaging the end of the tubular, and a stop plate for abutment against the other end of the tubular, the swaging head and the stop plate being movably coupled to one another.

Movement of the swaging head and the stop plate toward one another typically facilitates swaging of the said one end of the tubular.

Typically, the swaging head is moveable toward the stop plate by means of a piston, and preferably, the swaging head and the stop plate are movably coupled to one another by a frame. Typically, the frame is adjustable such that distance between the stop plate and the swaging head can be further varied by adjustment of the frame.

Typically, the frame comprising at least one member coupled to both of the swaging head and the stop plate, and preferably the coupling between the member and at least one of the stop plate and swaging head can be adjusted in order to vary the length of the member between the swaging head and the stop plate. Preferably, the coupling between the member and the stop plate is in the form of a screw thread engagement.

Preferably, the stop plate comprises a bore and a device for obturating the bore, such that when the device obturates the bore, the device abuts the said other end of the tubular. Typically, the device is removable from the stop plate such that a tubular to be swaged may be passed through the bore. This provides the invention with the advantage that the device can be inserted into or over the bore so that short lengths of tubular can be swaged, and the device can be removed from the stop plate so that longer lengths of tubular can be swaged.

According to a third aspect of the present invention provides an apparatus for swaging an end of a tubular, the apparatus comprising a swaging head for swaging the end of the tubular, and a clamping device for clamping the tubular, the clamping device being split into at least three part-circular clamping segments which clamp substantially around the outer circumference of the tubular to permit it to be swaged.

Preferably, there are at least four part-circular clamping segments which clamp substantially around the outer circumference of the tubular to permit it to be swaged.

Preferably, there are two clamping devices provided, typically a forward clamping device which is arranged to be closest to the swaging head, and a rear clamping device which is arranged to be furthest from the swaging head.

Typically, the clamping segments are housed within a clamping ring, and may be mounted on the clamping ring in an arrangement such that the segments can move, preferably only to a relatively small degree, with respect to the ring.

Preferably, the clamping ring is split into at least two part circular members, where the members may be hinged together, such that the ring may be opened to permit a tubular to be inserted into the ring, and closed to clamp the segments around the tubular.

Typically, a range of segments can be housed within the ring, where the range of segments may be of varying radial thickness, to permit a range of differing diameter tubulars to be clamped.

According to a fourth aspect, the present invention provides an apparatus for swaging a tubular, the apparatus comprising a swaging head for swaging the end of the tubular, and a clamping device for clamping the tubular, the clamping device having a plurality of teeth for gripping the outer surface of the tubular, and a plurality of grooves formed between the teeth, wherein the gripping surface of each tooth is substantially parallel co the longitudinal axis of the tubular to be gripped.

This provides the invention with the advantage that the teeth do not bite into the outer surface of the tubular, thus avoiding damaging the tubular.

The grooves may be formed with two side walls which are substantially perpendicular to the longitudinal axis of the tubular to be gripped, and may be formed with a lowermost surface which is substantially parallel to the longitudinal axis of the tubular to be gripped.

An embodiment of the present invention will now be described, by way of example only, with reference to the accompanying drawings, in which:

FIG. 1 shows an apparatus for swaging the end of a tubular or a pipe such as a length of casing or drillpipe used in the oil and gas industry.

Figure 1:
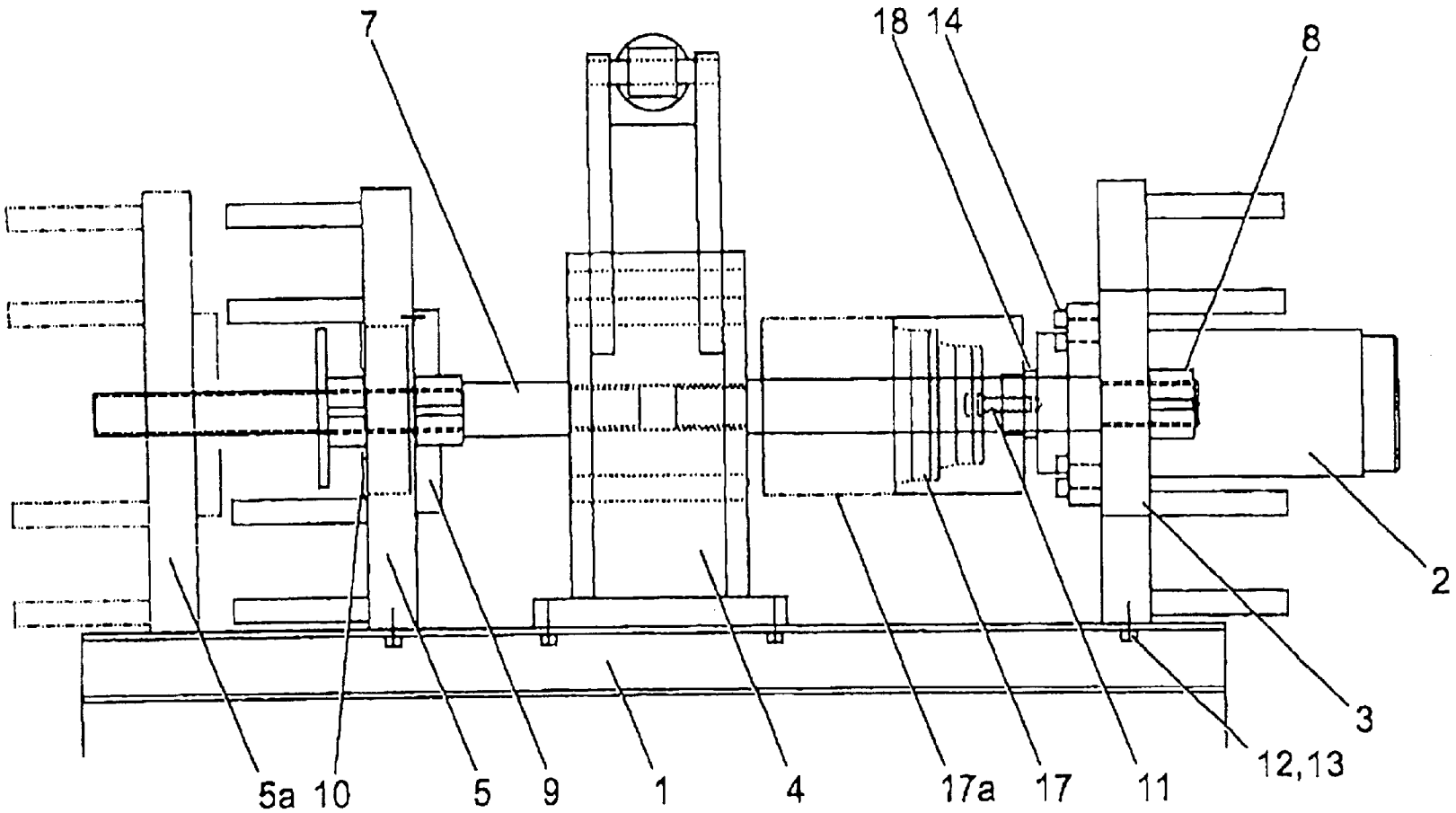
FIG. 1 is a side view of an apparatus for swaging an end of a tubular in accordance with the present invention.

The apparatus comprises a base frame 1 which, in use of the apparatus, would typically lie on a workshop floor. A press head 3 is mounted on the base frame 1 by means of a cap screw 12 and taper washer 13, such that the press head 3 stands vertically upright from the horizontally arranged base frame 1. A swaging cylinder 2 is mounted on the press head 3 by means of a plurality of cap screws 14, such that the longitudinal axis of the swaging cylinder 2 is arranged to be substantially horizontal. A piston rod 18 is located within the swaging cylinder 2, such that the piston rod 18 lies on the longitudinal axis of the swaging cylinder 2. The furthest end of the piston rod 1*a* is typically coupled to a swaging or die head 17 by means of a cap screw 11, such that actuation of the swaging cylinder 2 moves the piston rod 18, and hence die head 17 outwardly from the swaging cylinder 2, until the piston rod 18 has potentially traveled its maximum stroke or contact is made with the stop shoulder, which is indicated in FIG. 1 by the die heads 17 reaching its position which is shown in phantom 17A. As shown in FIG. 1, it is preferred that the maximum stroke of the piston rod 18, and hence die head 17, is twelve inches.

A clamping unit 4 is mounted on the base frame 1 at approximately the mid-point of the base frame 1, such that the clamping unit stands vertically upright with respect to the base frame 1. The clamping unit 4 will be described in more detail subsequently.

An end stop 5 is movably mounted upon the base frame 1, such that the end stop 5 stands vertically upright with respect to the base frame 1.

A first pair of struts or strengthening members in the form of tie rods 6 are provided between the press head 3 and the clamping unit 4, and are arranged to lie on the plane of the longitudinal axis of the swaging cylinder 2, on either side of the die head 17. The tie rods 6 are secured to the press head 3 by means of nuts 8, and are screw threaded to the clamping unit 4. A second pair of struts or strengthening members in the form of tie rods 7 act between the clamping unit 4 and the end stop 5, and are arranged to lie on the plane of the longitudinal axis of the swaging cylinder 2. The tie rods 7 are secured to the clamping unit 4 by means of screw threads, and are secured to the end stop 5 by means of a nut 19 on one side of the end stop 5, and a hand wheel nut 15 on the other side of the end stop 5. It should be noted that the majority of the outer surface of the tie rods 7 is provided with a screw thread formation thereon, such that an operator of the apparatus can rotate the hand wheel nut 15 to permit the end stop 5 to be moved along the tie rods 7 from the position of the end stop 5 shown in FIG. 1 to the position of the end stop 5A shown in phantom in FIGS. 1 and 2. Thus, the distance between the end stop 5 and the die head 17 can be varied.

Figure 2:
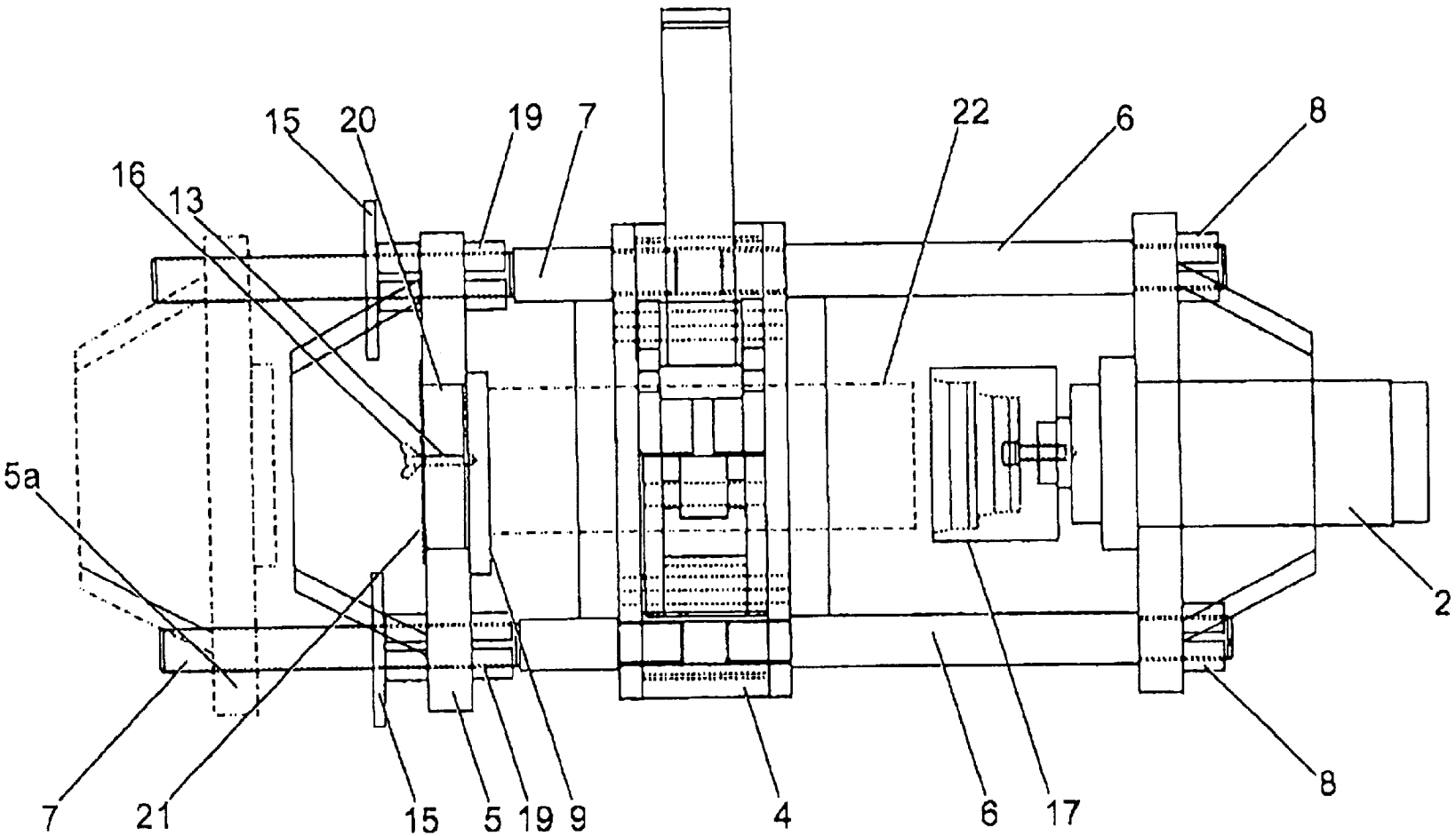
FIG. 2 is a plan view of the apparatus of FIG. 1.
Figure 3:
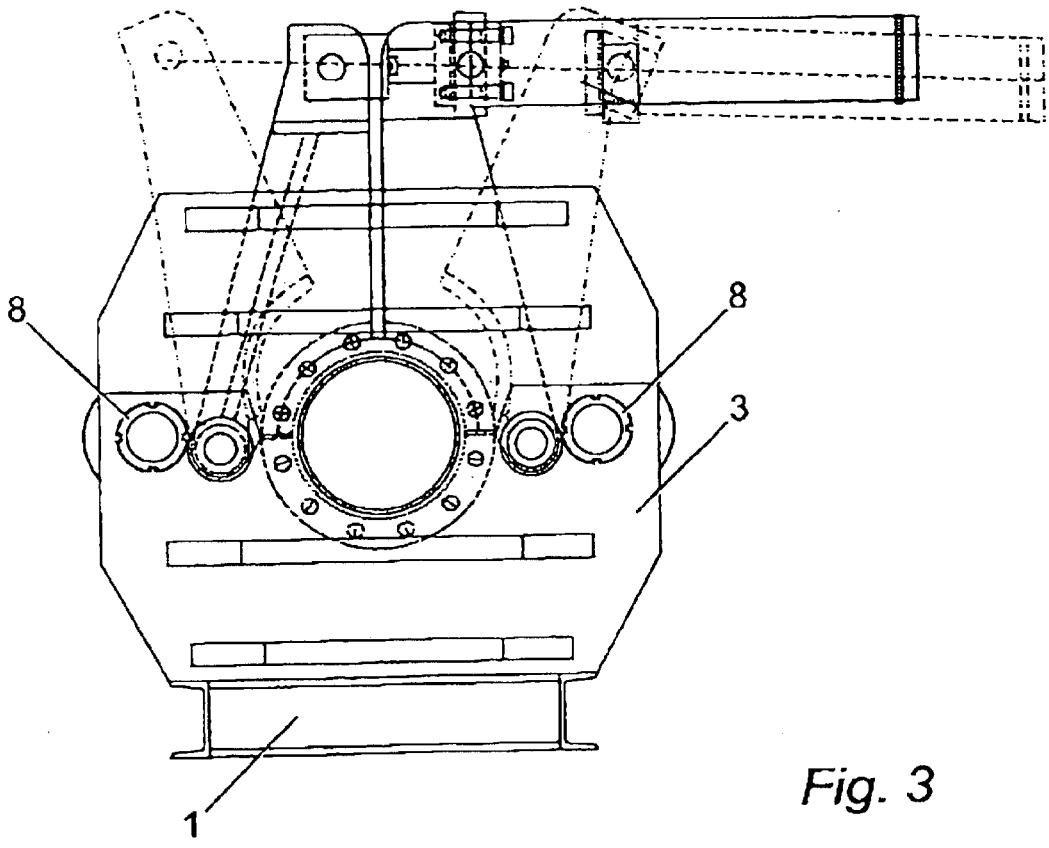
FIG. 3 is an end view of the apparatus of FIG. 1.

As shown in FIG. 2, the end stop 5 is provided with a bore 20, which can be obturated by placing a push plate 9 on the end stop 5, and attaching the push plate 9 by means of a stud 13, nuts 16 and a retaining plate 21.

Accordingly, the push plate 9 can be placed on the end stop 5, as shown in FIGS. 1 and 2, and the end stop 5 can be positioned so that the push plate 9 butts against an end of a relatively short length of pipe, such as a pup joint 22 used in the oil and gas industry. The middle of the pup joint 22 can be supported by the clamping unit 4, and the swaging cylinder 2 can be operated to move the die head 17 toward the closest end of the pup joint 22 to it, such that the die head 17 swages the end of the pup joint 22.

Figure 4:
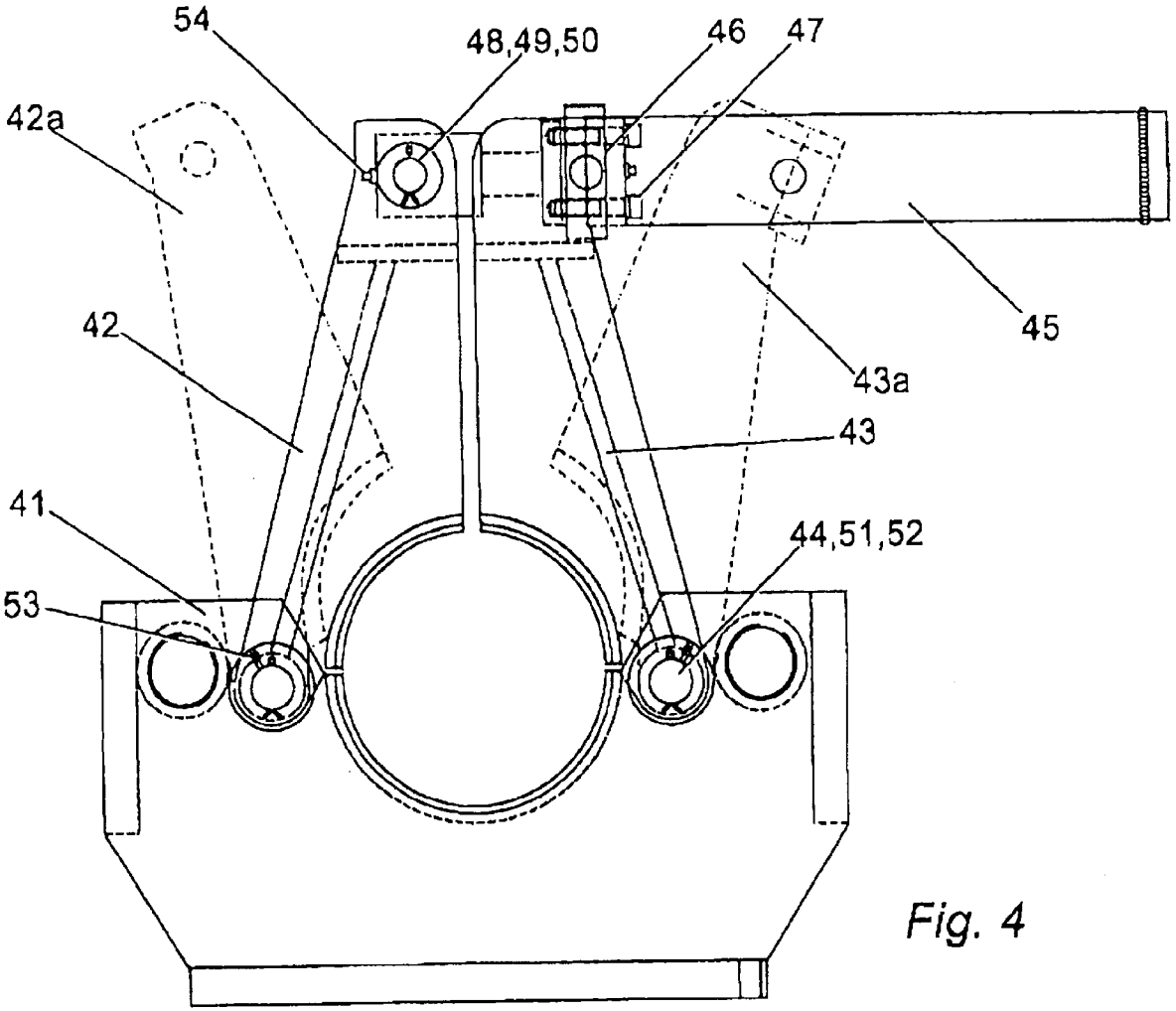
FIG. 4 is an end view of the clamping device of the apparatus of FIG. 1.
Figure 5:
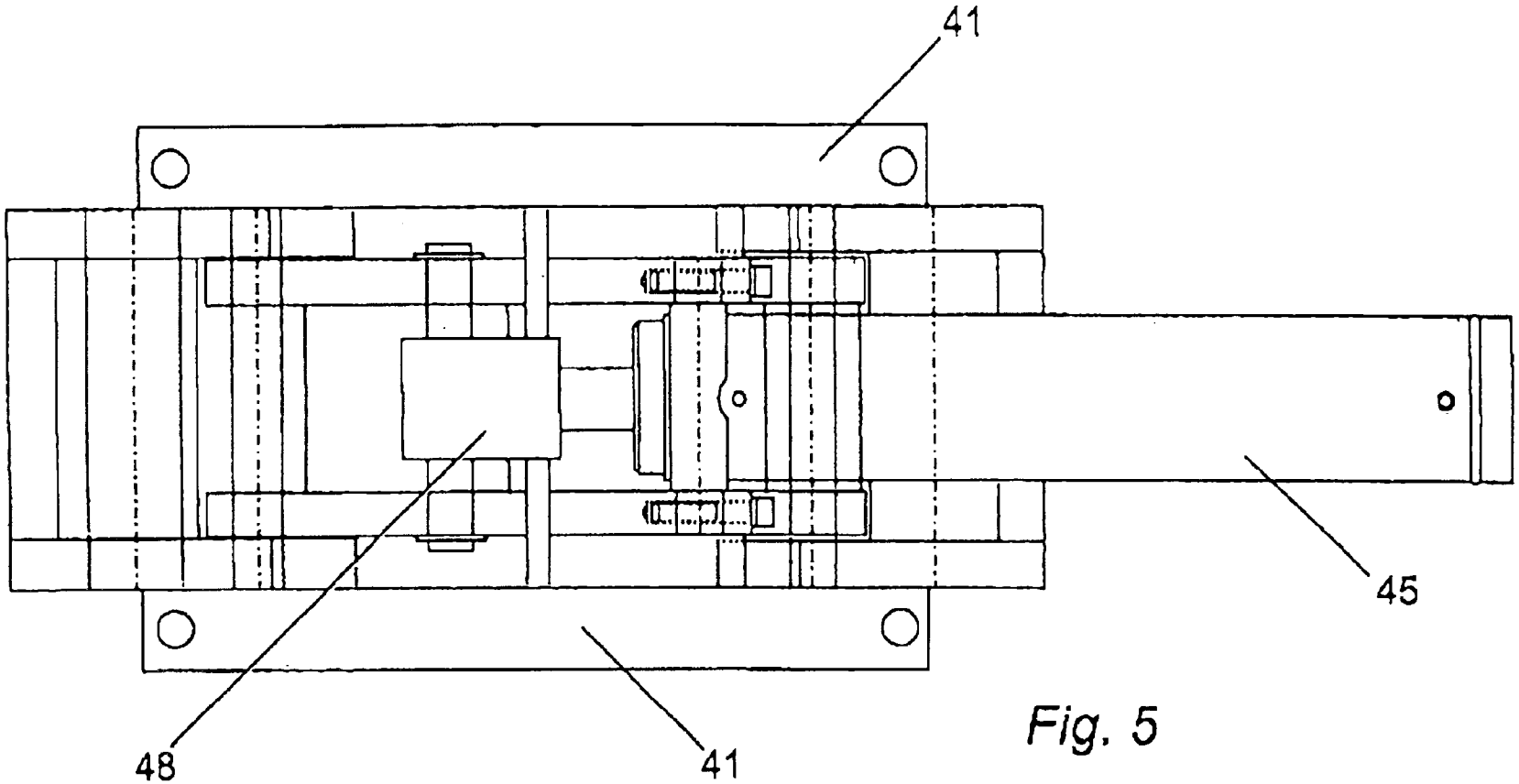
FIG. 5 is a plan view of the clamping device of FIG. 4.

As shown in FIG. 4, the clamping unit 4 comprises a clamp base 41, and a pair of clamp arms 42, 43 which are respectively hingedly coupled to the clamp base 41 by means of pivot pins 44, washers 51 and split pins 52 at the lowest ends of the respective clamp arms 42, 43. The upper ends of the clamp arms 42, 43 can be releasably coupled together by means of a cylinder 45 which is attached to one of the clamp arms 43 by means of a trunnion bearing half 46 and a socket head cap screw 47. A trunnion pin 48 is mounted on the other clamp arm 42 by means of a washer 49 and split pin 50, and the trunnion pin 48 is engageable with the trunnion bearing half 46, such that operation of the cylinder 45 pulls the clamp arms 42, 43 toward one another. However, it should be noted that the connection between the arms 42, 43 can be varied so as to make them interchangeable, for ease of production.

Thus, the clamp arms 42A, 43A are moveable from their open position shown in phantom on FIG. 4 in which a pipe (not shown) can be inserted into the clamp unit 4, to a closed position 42, 43 in which the clamping arms 42, 43 substantially surround a section of the outer circumference of the tubular.

Figure 6:
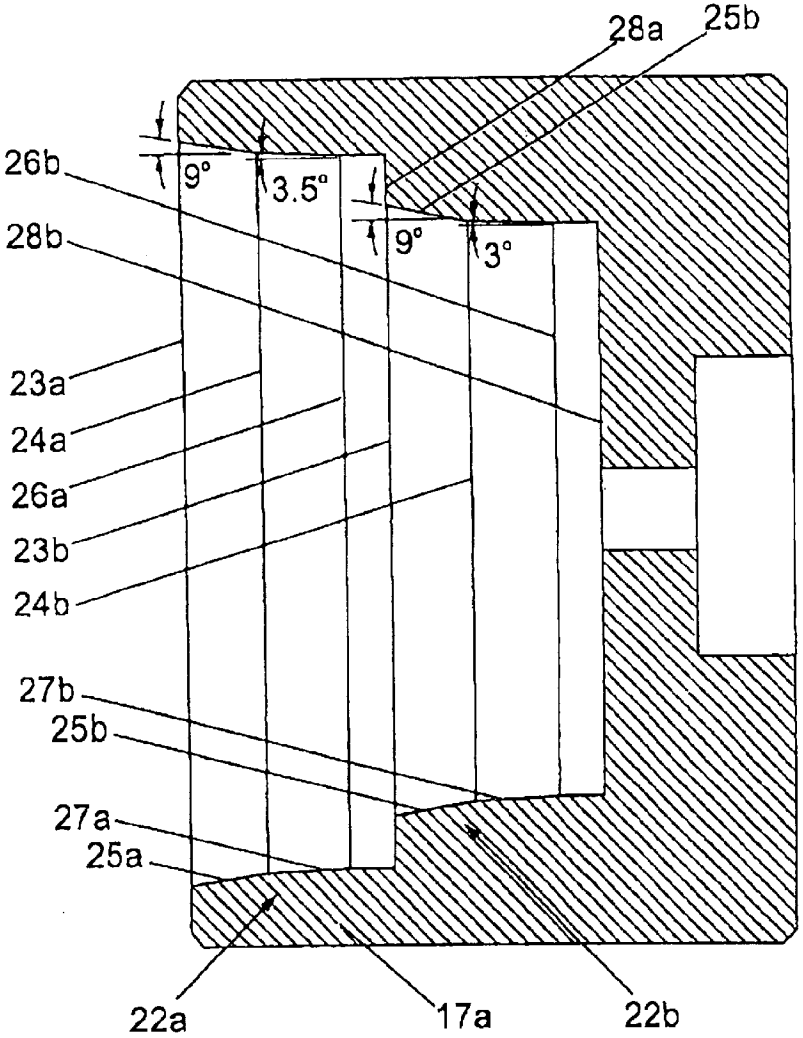
FIG. 6 is a cross-sectional view of a first swaging head for use of the apparatus of FIG. 1.

A first example of a "female" die head 17A is shown in FIG. 6, where this die head 17A is suitable for swaging two different pipe sizes, these being a relatively large pipe size of 13⅜, inches outer diameter, and a smaller pipe having an outer diameter of 10¾ inch. However, it should be noted that the specific dimensions of the diehead can be varied for different swaging requirements.

This example of the die head 17A has a first swaging formation, generally designated as 22A, and is formed on the internal bore of the die head 17A. This first swaging formation 22A has a first diameter 23A formed at the mouth of the internal bore of the die head 17A. A second diameter 24A is shown as being to the right of the first diameter 23*a* in FIG. 6, where the second diameter 24A is slightly smaller than the first diameter 23A (13.86 inches). The surface of the internal bore tapers linearly inwards from the first 23A to the second 24A diameters at an angle of 9° to the longitudinal axis of the die head 17, and forms a lead-in surface 25A to guide the pipe end into the internal bore of the die head 17. A third diameter 26A is shown in FIG. 6 as being to the right of the second diameter 24A, where the third diameter 26A is smaller (13.24 inches) than the second diameter 24A. The surface of the internal bore tapers linearly inwardly from the second 24A to the third 26A diameters at an angle of 3° to the longitudinal axis of the die head 17, where the surface between the second 24A and third 26A diameters forms a swaging surface 27A to provide a swage to the 13⅜ inch pipe end. A shoulder 28A projects radially inwardly at an angle perpendicular co the longitudinal axis of the die head 17 and provides a stop surface thereon to ensure that the die heads 17 cannot "overswage" the pipe end.

A second swaging formation 22B is also provided on the internal bore of the die heads 17, and is shown in FIG. 6 as being to the right of the first swaging formation 22A. The various diameters 23B, 24B, 26B of the second swaging formation 22B are all smaller than the respective diameters 23A, 24A, 26A of the first swaging formation 22A, and are of a size suitable for providing a swage to a 10¾ inch pipe.

Figure 7:
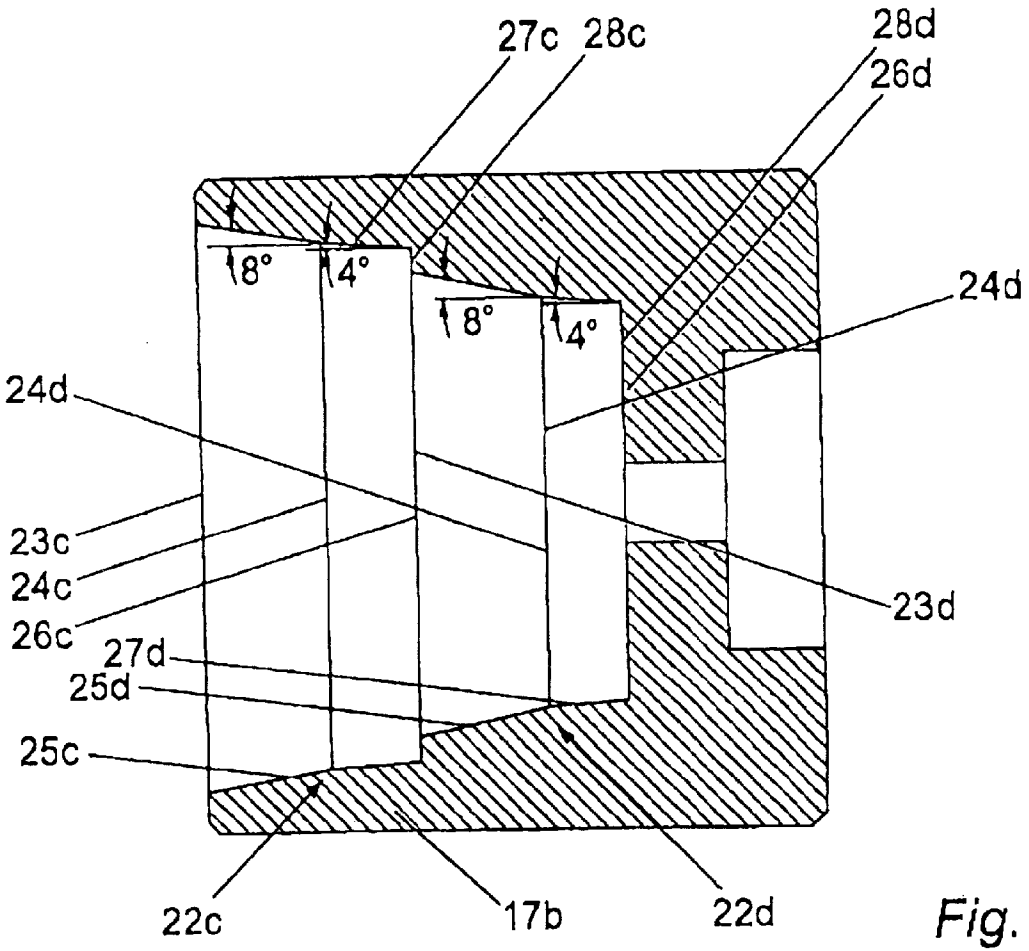
FIG. 7 is a second swaging head for use with the apparatus of FIG. 1.

FIG. 7 shows a second example of a die head 17B, and which has a first swaging formation 22C, which is similar to the first swaging formation 22A of the die head 17A, and a similar second swaging formation 22D. The swaging formations 22C, 22D are sized to provide a swage to respective pipe sizes 9⅝ inch and 7⅝ inch.

Figure 8:
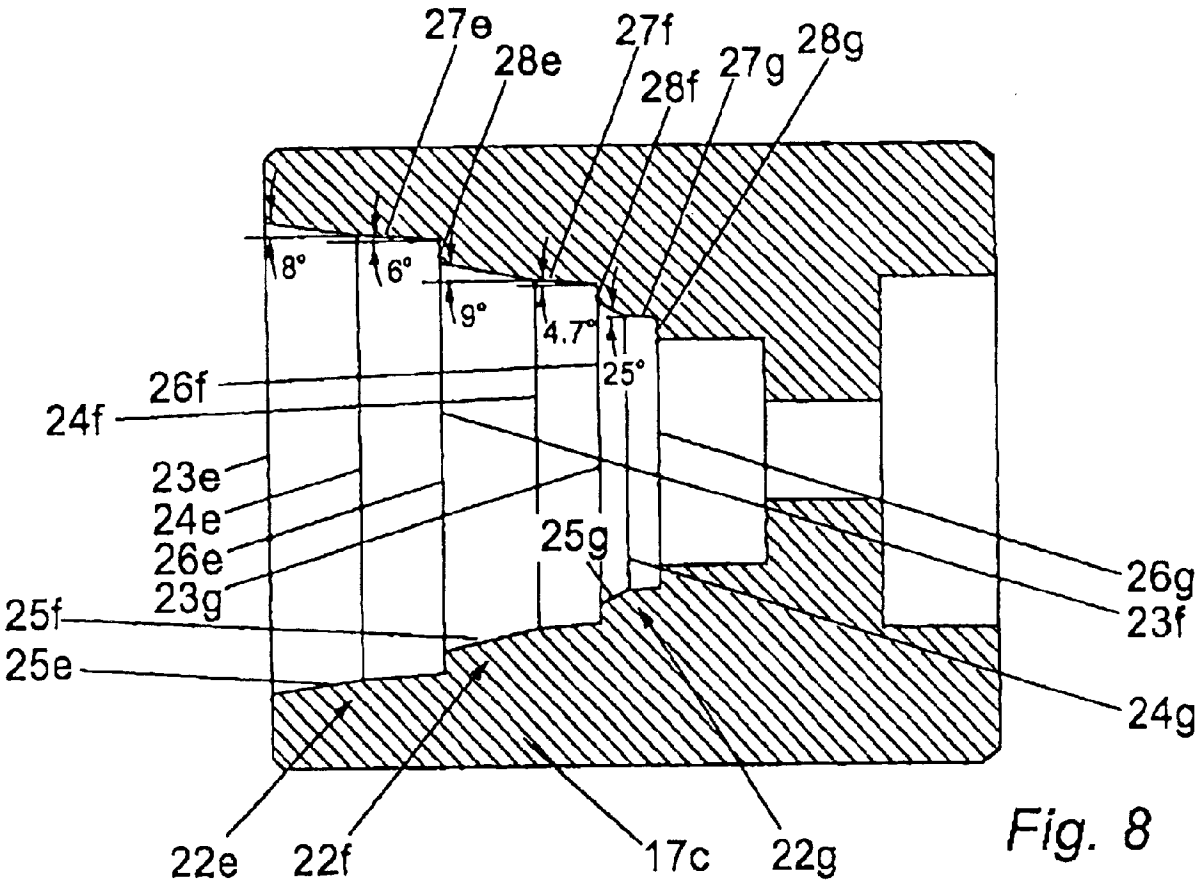
FIG. 8 is a third swaging head for use with the apparatus of FIG. 1.

FIG. 8 shows a third example of the die head 17C, where this die head 17C has three swaging formations 22E, 22F, 22G provided thereon to enable the die head 17C to provide a swage to three different pipe sizes these being respectively 7 inch, 5½ inch and 4½inch.

Figure 9:
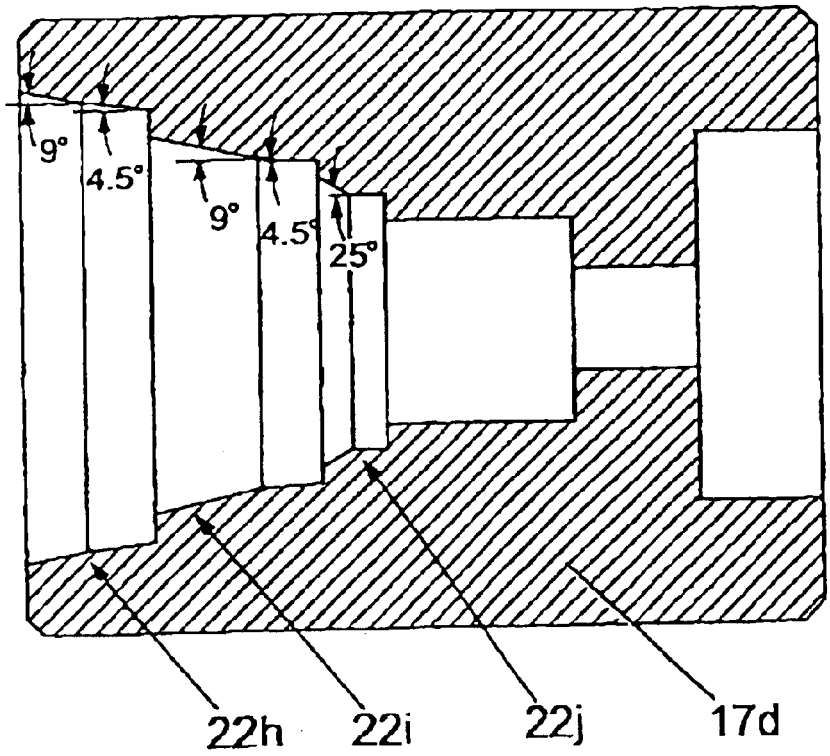
FIG. 9 is a fourth swaging head for use with the apparatus of FIG. 1.

FIG. 9 shows a fourth example of a die head 17D, also having three swaging formations 22H, 22I, 22J provided thereon to enable the die head 17D to provide a swage to three different pipe sizes, these being respectively 6⅝ inch 5 inch and 4 inch pipe diameters.

An operator of the apparatus can choose the correct die head 17A, B, C, D as required by the diameter of the pipe, and can attach the correct die head 17A, B, C, D by means of the cap screw 11.

It will also be appreciated by those skilled in the art that a die head having one or more swaging formations formed on it's outer circumference for providing a swage to the inner bore of an end of a tubular can also be provided for use with the apparatus, and such a range of "male" dieheads is shown in FIGS. 14 to 17. The one or more swaging formations on the outer circumference are, in essence, mirror images of the swaging formations hereinbefore described in detail.

Figure 10:
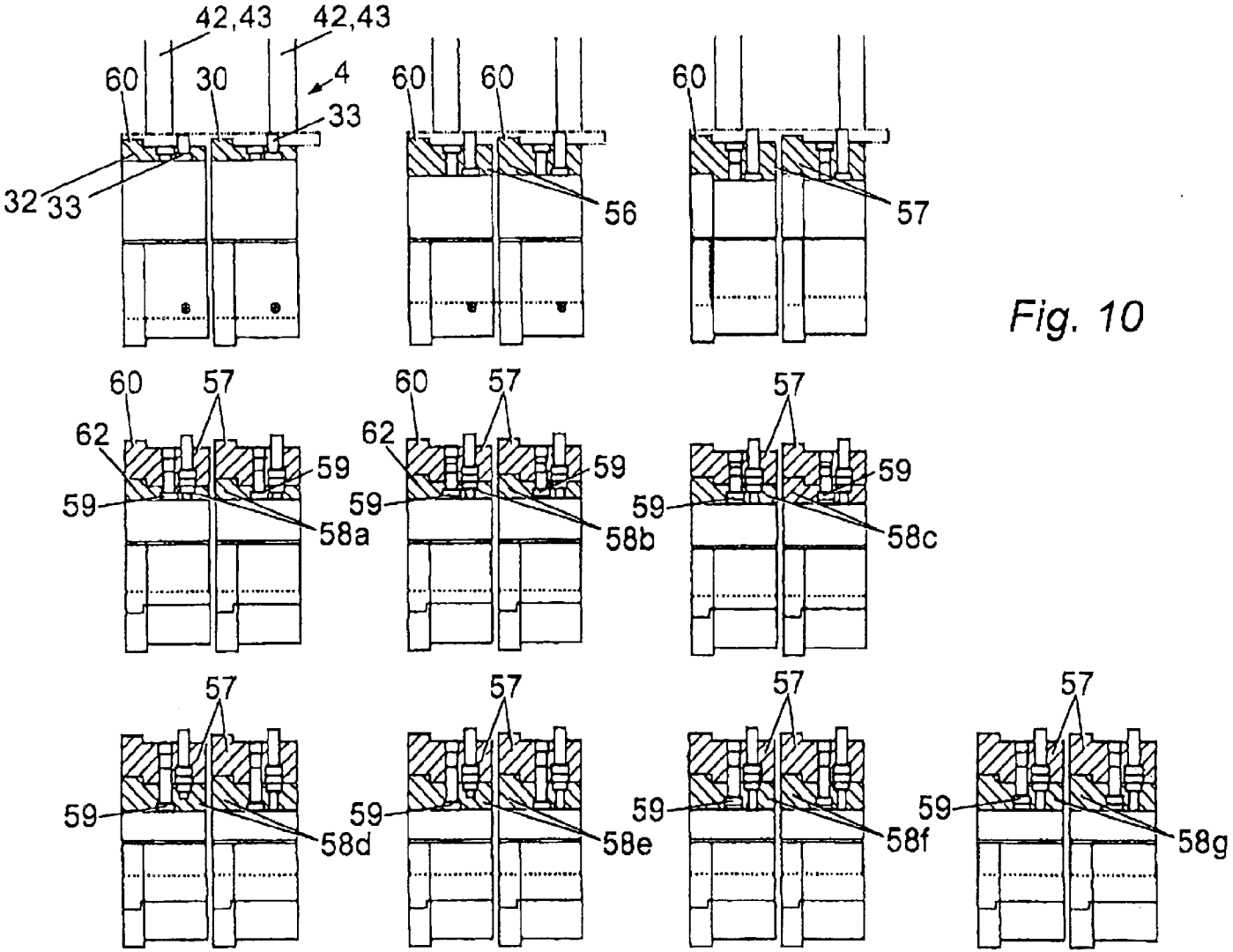
FIG. 10 is a series of part cross-sectional side views of gripping devices for use with the clamping device of FIG. 4.
Figure 12:
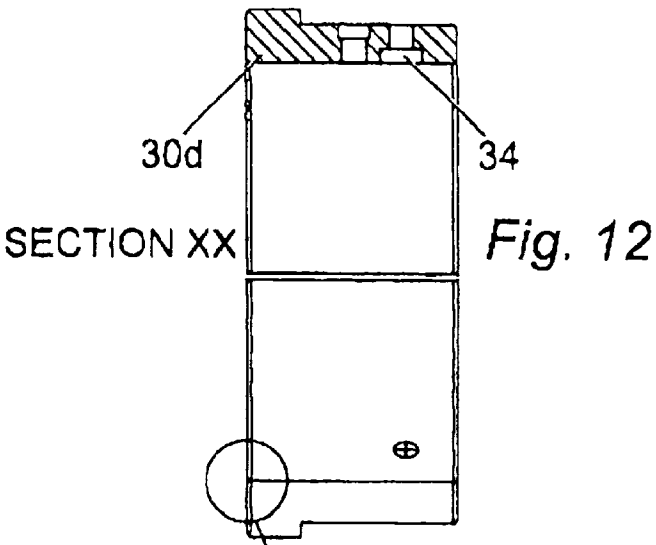
FIG. 12 is a part cross-sectional side view of the set of gripping devices of FIG. 11.
Figure 11:
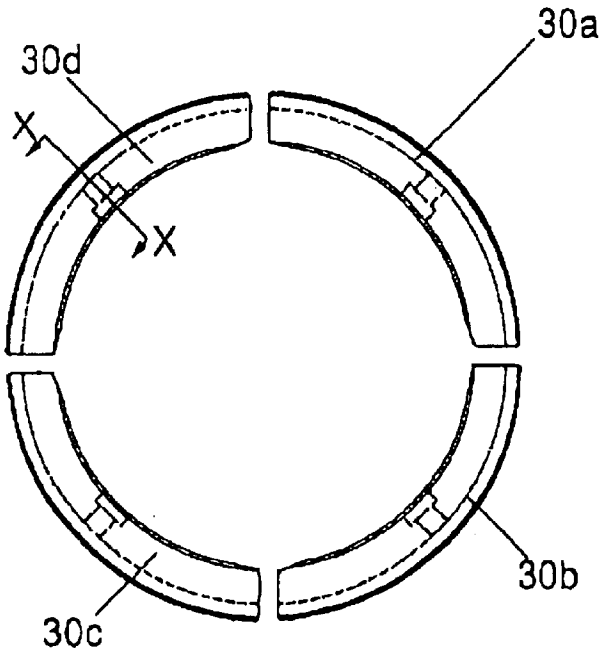
FIG. 11 is an end view of one of the sets of gripping devices of FIG. 10.
Figure 14:
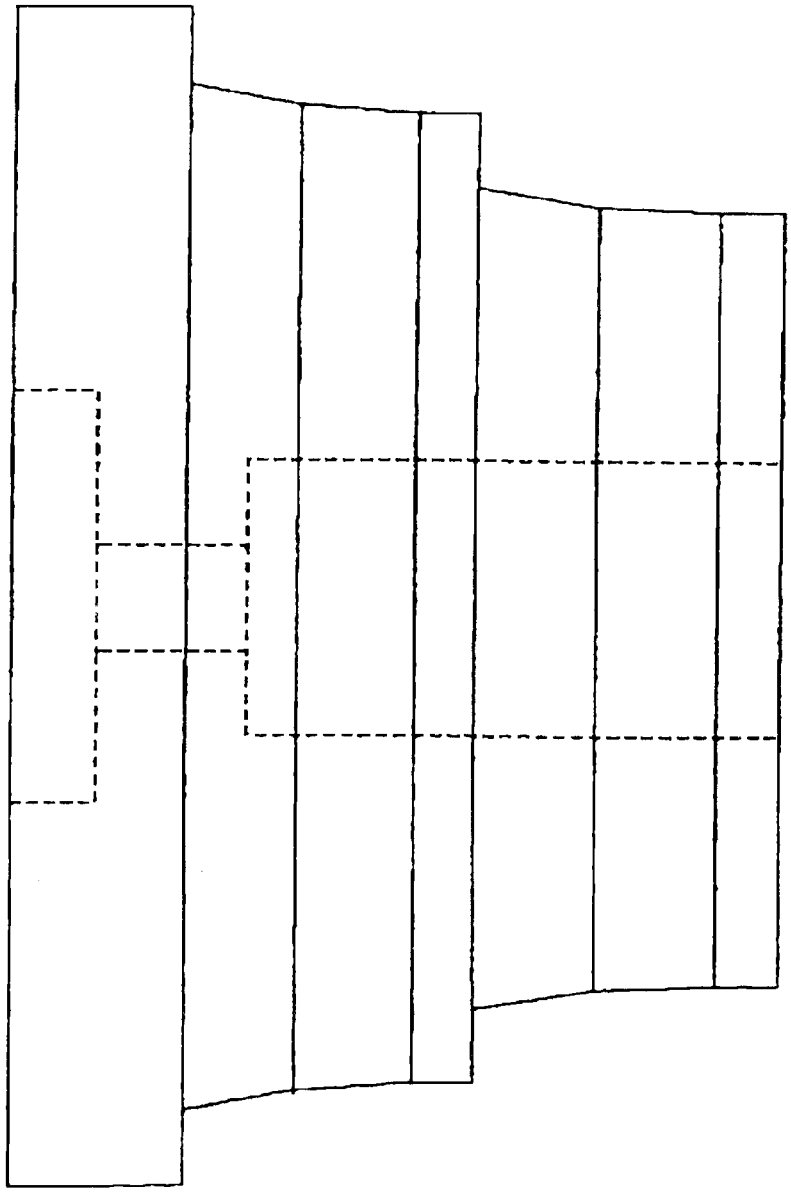
FIG. 14 is a side view of a first male swaging head for use of the apparatus of FIG. 1.
Figure 15:
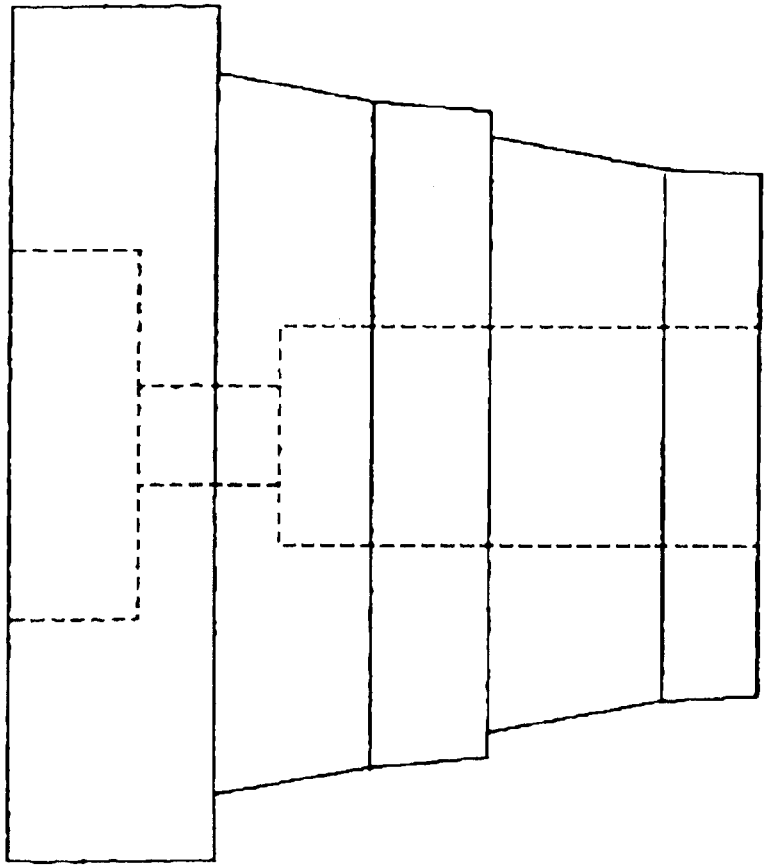
FIG. 15 is a second male swaging head for use with the apparatus of FIG. 1.
Figure 16:
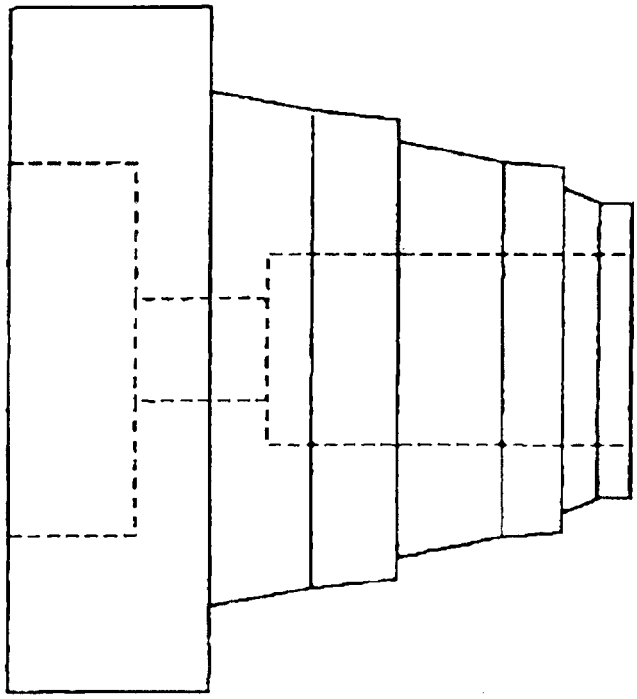
FIG. 16 is a third male swaging head for use with the apparatus of FIG. 1.
Figure 17:
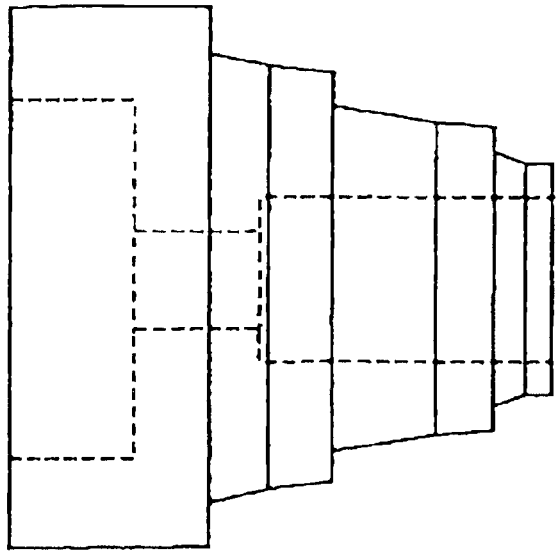
FIG. 17 is a fourth male swaging head for use with the apparatus of FIG. 1.

FIGS. 11 and 12 show one set of clamping segments or collets 30A, B, C, D where each clamping collet 30 circumscribes an angle of preferably slightly less than 90° of a circle. However, it should be noted that two sets of clamping collets 30, 32 are utilised in the apparatus, as will now be described. As shown in FIG. 10, a forward set 30 of collets is mounted to the clamping unit 4, where this first set 30 is arranged to be closest to the die head 17, and a rear set 32 of clamping collets is also mounted to the clamping unit 4. The two lower clamping collets 30B, 30C are mounted to the lower semi-circular bore of the clamp base 41, and one of the upper clamping collets 30A, 30B are mounted to the respective clamp arms 42, 43, where each clamping collet 30A, B, C, D is mounted to the clamping units by means of a fixing screw 33 which passes through a first aperture 34 in the respective clamping collet 30A, B, C, D. Thus, since there is only one fixing screw 33 per clamping collet, the clamping collets 30 can move slightly with respect to the clamping unit 4, and this provides the apparatus with the advantage that the clamping collets can move to compensate for slight irregularities in the outer circumference of the pipe to be swaged.

However, the two lower clamping collets 30B, 30C may be modified to be combined into one lower clamping collet (not shown) which would preferably circumscribe an angle of slightly less than 180° of a circle. This modified lower clamping collet is also preferably mounted on the clamping unit in a suitable arrangement such that it can move slightly with respect to the clamping unit 4.

Figure 13:
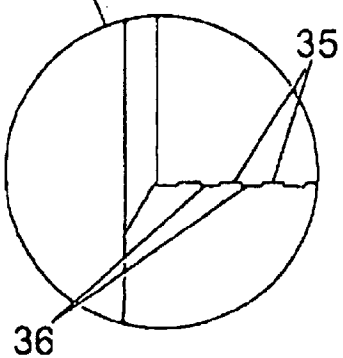
FIG. 13 is a detailed cross-sectional view of a portion of the gripping device of FIG. 12.

The inner bore of the clamping collets 30 is provided with a clamping formation thereon, as shown in FIG. 13. The clamping formation comprises a plurality of flat teeth 35 which are of equal width. The upper surface of the flat teeth 35 are parallel with the longitudinal axis of the pipe to be swaged and the flat teeth 35 are spaced apart by substantially flat troughs 36, where the flat troughs 36 are of substantially equal length with the flat teeth 35. In the clamping collets 30 shown in FIG. 13, there are six flat teeth 35 per inch along the internal surface of the clamping collets 30. The presence of the flat troughs 36 provide the advantage that corrosion or contamination appearing on the outer surface of the pipe to be swaged can be squeezed off by the flat teeth 35 and located within the flat troughs 36, thus providing an enhanced clamping action upon the pipe to be swaged.

Furthermore, the flat teeth 35 do not "bite" into the outer surface of the pipe to be swaged.

As shown in FIG. 10, there are ton arrangements of sets of clamping collets for clamping ten different diameters of pipe, although there may be additional sets provided for non-standard diameter pipes. The first set, as shown in set (1), is for clamping around the largest casing diameter normally used, this being 13.38 inches. Set (2) and set (3) are for clamping 10.75 inches and 9.63 inches diameter pipes respectively, with clamping collets 56 and 57 respectively. The clamping collets 57 of set (3) can be combined with different radius collet inserts 58A, B, C, D, E, F, G by means of fixing screws 59 to permit smaller diameter pipe sizes 7.62 inches, 7 inches, 6.62 inches, 5.5 inches, 5 inches, 4.5 inches and 4 inches respectively to be clamped. Thus, by combining the collet inserts 58A–G with the clamping collets 57, the apparatus has the advantage of providing a flexible arrangement for clamping and thereafter swaging a variety of different diameter pipe sizes.

As stated before, the push plate 9 can be located on the end stop 5 to permit short lengths of pipe such as pup joints 22 to be swaged; clamping unit 4 is not used in this case and the two lower clamping collets 30B, 30C support the pup joint 22 at its mid point. For longer lengths of pipe, the push plate 9 is removed, and the pipe end to be swaged is passed through the bore 20 of the end stop 5, and the clamp arms 42, 43 are closed around the outer diameter of the pipe.

The die head 17 is typically pushed onto the end of the pipe to be swaged, with typically 350 tons of push being applied. With this amount of push being applied, a shoulder 60 is provided on the clamping collets 30, 32, 56, 57, and a shoulder 62 is provided on the collet inserts 58A–G, to ensure that the respective screws 33, 59 are not broken when the push is applied.

The hydraulic pressure requirements of the cylinder 2 are thus very high, and for many pipes, the piston push a provided by the cylinder 2, 45 will be too great. Therefore, there is provided a safety control system, on both the clamp unit 4 to ensure that the pipe is not crushed, and also on the die head piston cylinder 2, to ensure that overpressure is not applied when swaging. An unloading valve is included in the hydraulic fluid control circuit and is arranged to dump overpressure of hydraulic fluid back into the hydraulic fluid reservoir. The unloading valve is actuated by the electronic circuit. Before swaging a pipe, the operator of the apparatus looks up the characteristics of the pipe in a manual provided with the apparatus, where the characteristics are typically weight or wall thickness, the grade of metal used in the pipe, and the outside diameter of the pipe. The manual then informs the operator what the safe pressure or load that the operator can apply to both the clamp unit and the swaging cylinder 2. The operator then inputs this safe pressure or load into the electronic circuit which, if this safe pressure or load is exceeded, the electronic circuit then operates the unloading valve. Operation of the unloading valve however retains the intended safe working pressure or load. A visual indicator may be used in addition, or in the alternative to the electronic circuit, to indicate that the correct pressure has been achieved.

Modifications and improvements may be incorporated into the embodiment without departing from the scope of the invention.

What is claimed is:

1. An apparatus for swaging an end of a tubular, the apparatus comprising:

a swaging head for providing the swage to the end of the tubular, wherein the swaging head has two or more swaging formations provided thereon to permit swaging of differing diameters of tubular ends, wherein each swaging formation is provided on an internal bore of the swaging head, such that the internal bore of the swaging head is capable of engaging the outer diameter of the tubular end to provide the swage thereto, and wherein each swaging formation comprises a first diameter of the swaging head, a second diameter being smaller than the first diameter, a third diameter being smaller than the second diameter, and a fourth diameter being smaller than the third diameter.

2. An apparatus according to claim 1, wherein the internal bore of the swaging head tapers substantially linearly inwardly, with respect to the longitudinal axis of the swaging head, from the first diameter to the second diameter, and from the second diameter to the third diameter.

3. An apparatus according to claim 1, wherein the angle of the taper from the first to the second diameter is greater than the angle of the taper from the second to third diameter.

4. An apparatus according to claim 1, wherein the surface of the internal bore of the swaging head provided by the taper from the first to the second diameter is a guiding surface, and the surface provided by the taper from the second to third diameter is a swaging surface.

5. An apparatus according to claim 1, wherein the surface of the internal bore of the swaging head from the second/third diameter to the third/fourth diameter is arranged to be substantially perpendicular to the longitudinal axis of the swaging head.

6. An apparatus according to claim 5, wherein the surface of the internal bore of the swaging head from the second/third diameter is arranged to provide a shoulder or a stop surface against which the tubular end arrests, in use.

7. An apparatus according to claim 1, wherein the swaging head is arranged with at least first and second swaging formations, whereby the fourth diameter of the first swaging formation is greater than the first diameter of the second swaging formation.

8. An apparatus according to claim 1, wherein the first diameter of the first swaging formation is the closest diameter of all of the diameters of all of the swaging formations to the tubular end, in use.

9. An apparatus for swaging an end of a tubular, the apparatus comprising:

a swaging head for providing the swage to the end of the tubular, wherein the swaging head has two or more swaging formations provided thereon to permit swaging of differing diameters of tubular ends, wherein each swaging formation is provided on an external diameter of the swaging head, such that the external diameter of the swaging head engages the inner diameter of the tubular end to provide the swage thereto, wherein each swaging formation comprises a first diameter of the swaging head, a second diameter being greater than the first diameter, a third diameter being greater than the second diameter, and a fourth diameter being greater than the third diameter.

10. An apparatus according to claim 9, wherein the external diameter of the swaging head tapers substantially linearly outwardly, with respect to the longitudinal axis of the swaging head, from the first diameter to the second diameter, and from the second diameter to the third diameter.

11. An apparatus according to claim 10, wherein the angle of the taper from the first to the second diameter is greater than the angle of the taper from the second to third diameter.

12. An apparatus according to claim 10, wherein the surface of the external diameter of the swaging head provided by the taper from the first to the second diameter is a guiding surface, and the surface provided by the taper from the second to third diameter is a swaging surface.

13. An apparatus according to claim 9 wherein the surface of the external diameter of the swaging head from the second/third diameter to the third/fourth diameter is arranged to be substantially perpendicular to the longitudinal axis of the swaging head.

14. An apparatus according to claim 13, wherein the surface of the external diameter of the swaging head from the second/third diameter to the third/fourth diameter is arranged to provide a shoulder or a stop surface against which the tubular end arrests, in use.

15. An apparatus according to claim 9, wherein the swaging head is arranged with at least first and second swaging formations, whereby the fourth diameter of the first swaging formation is smaller than the first diameter of the second swaging formation.

16. An apparatus according to claim 9, wherein the first diameter of the first swaging formation is the closest diameter of all of the diameters of all of the swaging formations to the tubular end, in use.

* * * * *